United States Patent [19]

Breyer et al.

[11] Patent Number: 4,724,924

[45] Date of Patent: Feb. 16, 1988

[54] CONTROL HANDLE ARRANGEMENT FOR AERIAL BUCKET LIFT

[75] Inventors: Randall E. Breyer, Lorena; Raymond Fritel, Hewitt, both of Tex.

[73] Assignee: O'Flaherty Finance Corporation, Waco, Tex.

[21] Appl. No.: 43,874

[22] Filed: Apr. 29, 1987

[51] Int. Cl.[4] ..... B66F 11/04

[52] U.S. Cl. ..... 182/2; 74/491

[58] Field of Search ..... 182/2, 63, 141; 74/491

[56] References Cited

U.S. PATENT DOCUMENTS

| | | | |
|---|---|---|---|
| 2,836,467 | 5/1958 | Myers | 182/2 |
| 2,877,660 | 3/1959 | Rush | 182/2 |
| 2,977,769 | 4/1961 | Troche | 182/2 |
| 3,066,756 | 12/1962 | Broderson | 182/2 |
| 3,082,842 | 3/1963 | Balogh | 182/2 |
| 3,964,504 | 6/1976 | Inhofer | 182/2 |
| 4,437,543 | 3/1984 | Fortin | 182/2 |
| 4,520,894 | 6/1985 | Hensler | 182/2 |
| 4,660,730 | 4/1987 | Holmes | 182/2 |

*Primary Examiner*—Reinaldo P. Machado

*Attorney, Agent, or Firm*—Wm. T. Wofford; James C. Fails; Arthur F. Zobal

[57] ABSTRACT

In an aerial lift having a lower boom, an upper boom, and a personnel carrier bucket attached to the upper boom, with the upper boom having an overcenter capability, wherein the upper boom can pivot from a folded position in a non-overcenter zone of operation past a center position and into an overcenter zone of operation, there is provided a control handle arrangement with first and second handles having control movements such that, when the operator is correctly positioned, the direction the bucket moves corresponds to the direction the respective handle moves for all zones of operation.

8 Claims, 8 Drawing Figures

CONTROL HANDLE ARRANGEMENT FOR AERIAL BUCKET LIFT

FIELD OF THE INVENTION

The present invention relates to control handle arrangements for aerial lifts of the type incorporating a lower boom, an upper boom and a personnel carrier bucket with the lower and upper booms moving in an articulated fashion.

BACKGROUND OF THE INVENTION

Aerial lifts provide a mobile and aerial work platform which may be used for a variety of purposes. Such aerial lifts are usually mounted on a truck or other vehicle and have a lower boom, an upper boom and a personnel carrier bucket attached to the upper boom. The operator, upon climbing into the bucket, is able to change his position relative to the ground by controlling the movements of the lower boom, the upper boom or both. The lower boom pivots about one end in a generally vertical plane, the upper boom pivots about the upper end of the lower boom in roughly the same vertical plane, and both booms together rotate or swing about a vertical axis. The controls for each of these boom movements are often combined into a single control handle, which handle is located to one side of the bucket. Prior art control handles allow for one-handed control and can be moved in various directions to affect boom movement.

Some types of non-telescoping aerial lifts have an overcenter capability wherein the upper boom is able to unfold from the stowage position and rotate past a center position which is where the longitudinal axis of the upper boom is vertical. Overcenter positions of the upper boom are used for obtaining maximum working reaches of a particular aerial lift. When the operator unfolds or raises the upper boom and thus the bucket from the stowage position, he is in the non-overcenter zone of operation. As the upper boom continues to unfold, it will reach a center position and will then enter into the overcenter zone of operation.

When controlling the movements of the booms, the operator will usually face outwardly (that is the direction away from the above-mentioned imaginary vertical line extending through the lower boom upper end portion) and place one hand on the control handle. It is preferable for the bucket to move generally in the same direction as the control handle is moved. That is, the direction of elevation of the booms and the direction of their rotation about the vertical axis of the pedestal structure will generally correspond with the directions of control handle movements. Prior art control handles typically provide for correspondence between handle motion and bucket motion (boom elevations and rotation) in the non-overcenter zone. However, this correspondence between the handle and bucket motions is not carried over into all operational zones by any prior art control handles. As the bucket goes into some operational zones, for example, the overcenter zone of operation from the non-overcenter zone of operation, the operator turns around inside of the bucket 180° to again face outwardly and thereby places his other hand on the control handle so as to control the movements of the booms. While in the overcenter zone of operation, the necessary control handle movements, for upper boom and swing control, relative to the desired direction of bucket movement reverse from the non-overcenter control handle movements. The bucket operator may easily become confused when deciding how to move the bucket in the overcenter zone of operation, as a result of the switching of hands and changes in the requisite control handle movements.

In addition, the control handles of the prior art have been deficient in providing the operator with comfort and convenience in reaching and manipulating the control handle.

The objective of the present invention is to provide a control handle arrangement that provides correspondence between handle motion and bucket motion for all zones of operation, while at the same time providing the operator with comfort and convenience in reaching and manipulating the control handle.

DESCRIPTION OF A PREFERRED EMBODIMENT

Figure 1:
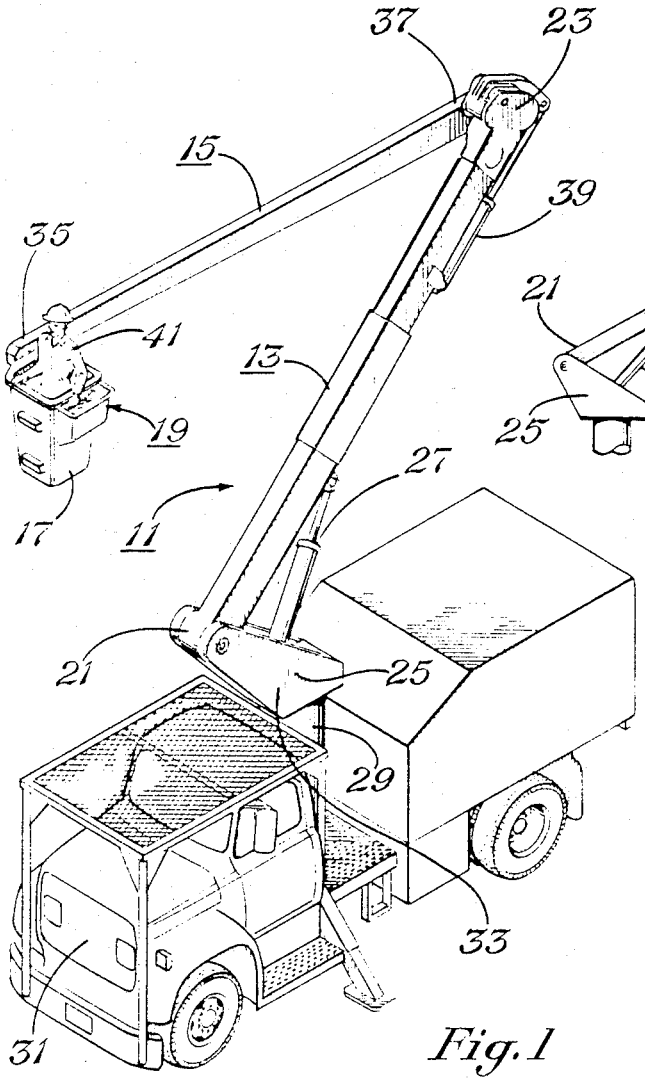
FIG. 1 is a schematic isometric view of a truck-mounted aerial lift showing the upper boom in a non-overcenter position, with said aerial lift incorporating the control handle arrangement of the present invention.

In FIG. 1, there is shown a truck-mounted aerial lift which incorporates a control handle arrangement of the present invention. The aerial lift 11 includes a lower boom 13, an upper boom 15, a personnel carrier bucket 17 (also known as the "work platform", or simply "platform"), and a control assembly 19.

The lower boom 13 has a lower end 21 and an upper end 23 The lower boom lower end 21 is connected to a support arm structure 25 for pivotal movement of the lower boom 13 about the lower end 21 in a generally vertical plane. Conventional means 27 are provided for powering the pivotal movement of the lower boom 13. The support arm structure 25 is conventionally mounted for rotational movement about a vertical axis on a pedestal structure 29 which in turn is mounted onto a truck 31. The support arm structure 25 is powered by conventional means 33 so as to provide swinging movement of the lower and upper booms 13, 15.

The upper boom 15 has an outer end 35 and an inner end 37 with a longitudinal axis extending between the ends. The upper boom inner end 37 is coupled to the lower boom upper end 23 in a conventional manner. The upper boom 15 pivots about its connection with the lower boom in a generally vertical plane from a folded position, where the upper boom is generally parallel to the lower boom 13 and the upper boom outer end is in near proximity to the lower boom lower end, to some maximum unfolded position. Conventional means 39 are provided for powering the pivotal movement of the upper boom 15.

The personnel carrier bucket 17 is mounted to the upper boom outer end portion 35 in a conventional manner. In the illustrated embodiment, the control assembly 19 is mounted on the side of the bucket opposite from that side of the bucket to which the upper boom is connected (see FIG. 4).

Figure 3:
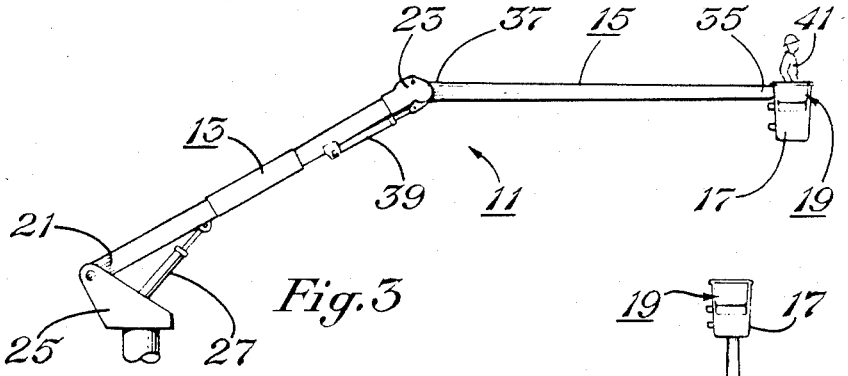
FIG. 3 is a schematic side elevational view of the aerial lift of FIG. 1, showing the upper boom in an overcenter position.
Figure 2:
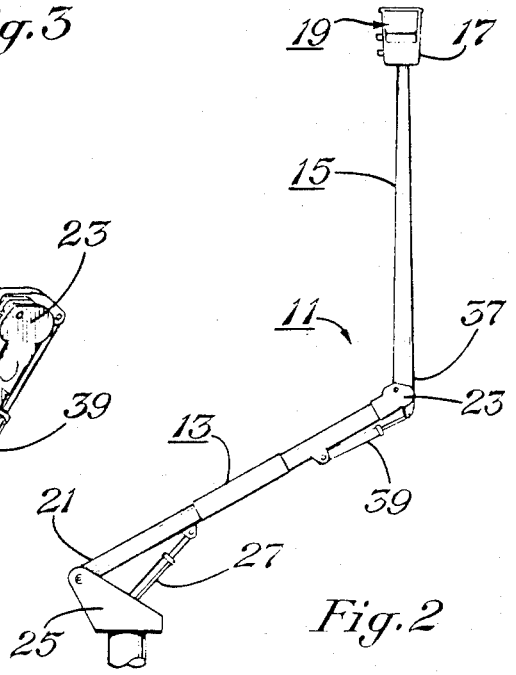
FIG. 2 is a schematic side elevational view of the aerial lift of FIG. 1, showing the upper boom in a center position.

The aerial lift 11 shown in FIGS. 1–3 is said to have an overcenter capability. In FIG. 2, the upper boom 15 is shown to be in a center position which is defined as that position of the upper boom wherein the longitudinal axis of the upper boom 15 is vertical, line regardless of the position of the lower boom 13. In FIG. 1, the upper boom 15 is shown in a non-overcenter position, which position lies in a non-overcenter zone of operation. The upper boom non-overcenter zone of operation is bounded by the folded position (not shown) of the upper boom and the center position of the upper boom. In FIG. 3, the upper boom 15 is shown in an overcenter position, which lies in an overcenter zone of operation. The overcenter zone of operation is bounded by the center position of the upper boom and the maximum unfolded position of the upper boom 15. To reach the overcenter zone of operation, the upper boom is pivoted from its folded position past the center position and into the overcenter zone. For convenience, an operator 41 in the bucket 17 usually faces outwardly and away from the imaginary vertical line extending through the lower boom upper end portion. Thus in FIG. 1, when the upper boom 15 is in a nonovercenter position, the operator 41 uses his left hand on the control assembly 19. However, in FIG. 3, with the upper boom 15 in an overcenter position, the operator has turned around 180° to again face outwardly and uses his right hand on the control assembly 19. The position of the operator and his manipulation of the control handle for the various zones of operations will be hereinafter more fully described.

Figure 5:
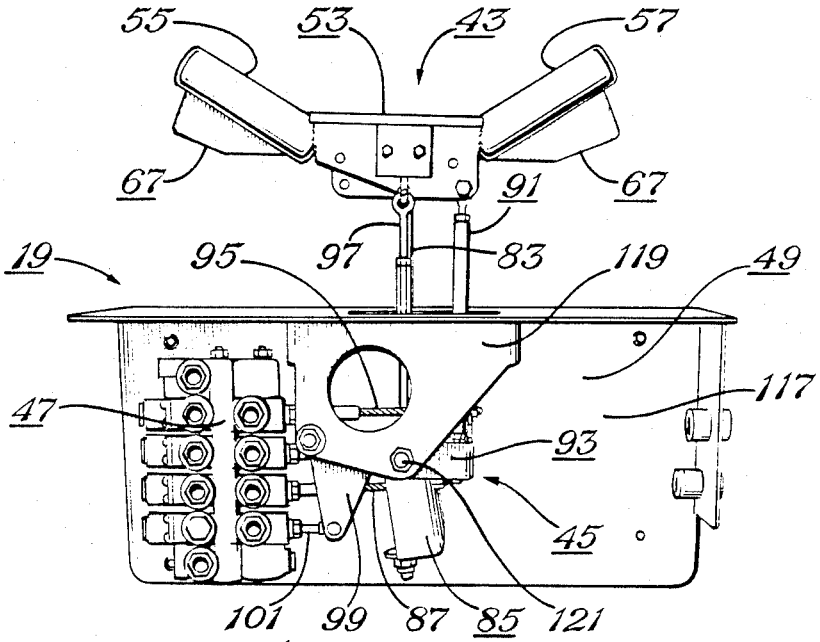
FIG. 5 is a schematic side perspective view of the handle means, the linkage means, the control valve assembly and the mounting means before their installation onto a bucket.
Figure 4:
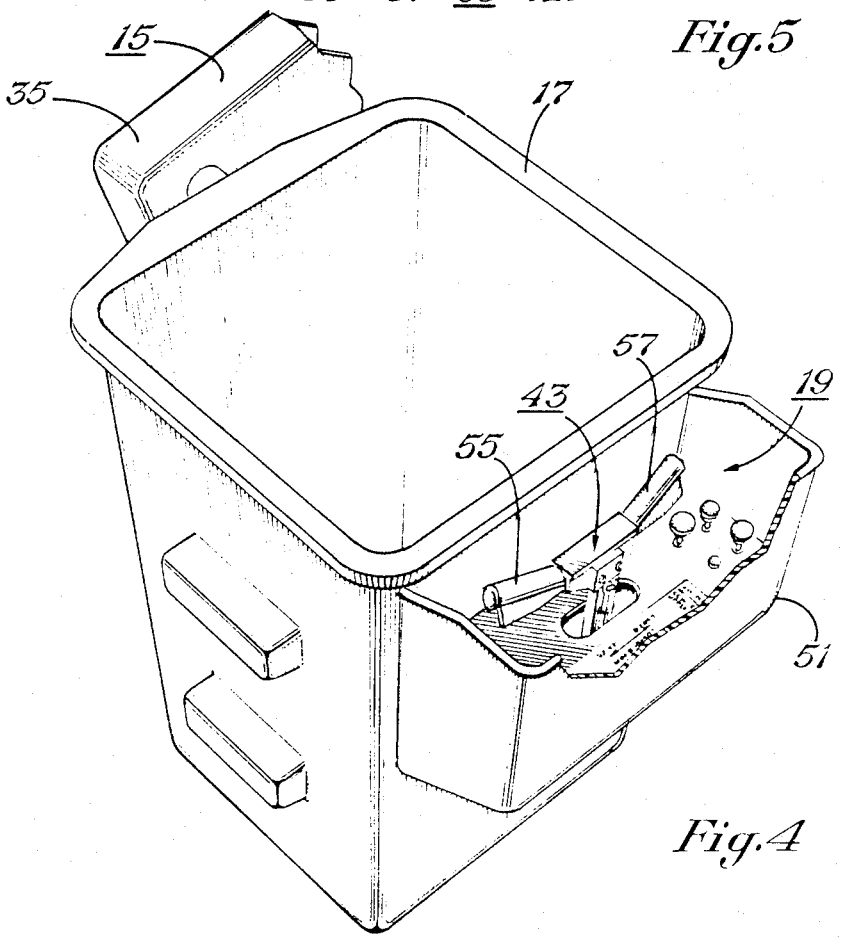
FIG. 4 is a schematic perspective view of the bucket of FIG. 1 showing the control assembly, which includes the control handle arrangement of the present invention, in accordance with a preferred embodiment, mounted on a bucket.

Referring now to FIGS. 4 and 5, the control assembly 19 will be discussed. The control assembly 19 includes the control handle arrangement 43, 45 of the present invention, in accordance with a preferred embodiment, a control valve assembly 47, mounting means 49, and a cover 51.

Figure 7:
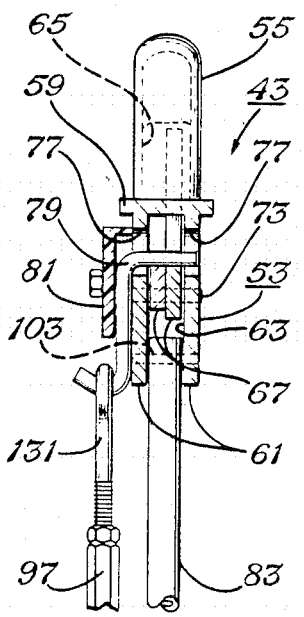
FIG. 7 is a schematic cross sectional view of the handle means of FIG. 6, taken at lines VII—VII.

The control handle arrangement includes handle means 43 and linkage means 45. The handle means 43 will be described first, with reference to FIGS. 6 and 7. The handle means has a central portion 53, a first handle 55, and a second handle 57. The central portion 53 is generally rectangular having two opposite ends. The central portion 53 is made up of a top wall 59 and two side walls 61 depending from the top wall. The top and side walls form an inverted U-shaped channel 63 which is open along the bottom side and at the ends of the central portion 53. The first and second handles 55, 57 extend outwardly and with an upward inclination from the respective ends of the central portion 53. The handles, which are generally cylindrical in shape, are welded to the central portion 53 such that the longitudinal axes of the handles lie in a common plane. Each handle 55, 57 has a cavity 65 that is open along the bottom side and the inner end of the handle. The handles 55, 57 are positioned on the respective ends of the central portion 53 such that the handle cavities 65 are aligned with the central portion channel 63.

A boom enablement or "dead man" trigger 67 is received by each of the handle cavities 65. Each trigger 67 is a flat plate having a handle portion 69 and an inner portion 71. The handle portions 69 of the triggers 67 are received by the respective cavities 65 of the first and second handles 55, 57. The inner portions 71 of the triggers extend from the respective handle portion 69 through the central portion channel 63 almost to the other handle cavity 65, where the ends of the inner portions are retained with clevis pins 73. Thus, the central portion channel 63 receives both of the trigger inner portions 71. The inner portions 71 of the triggers 67 are shaped so that each clevis pin 73, while serving as a pivot point for one trigger, also serves as a support for the other trigger, thereby arresting any further downward movement for the other trigger. The triggers 67 are supported by the clevis pins such that a portion of the handle portions 69 of each trigger lies exposed from out of the respective handle cavity 65. To actuate a trigger 67, the operator grips a handle and with his fingers squeezes the respective trigger up into the respective trigger cavity. The top edges of the trigger inner portions 71 have notches 75 that are aligned with each other and that are located midway between the central portion ends. Each central portion side wall 61 has a circular opening 77 that is aligned with the notches 75 in the inner portions of the triggers. The notches 75 and side wall openings 77 receive the upper end portion of a control link 79. The central shank portion of the control link 79 is bent 90° from the upper end portion to descend one of the central portion side walls 61 to the bottom of the central portion where the lower end portion of the control link curves upwardly and away from the side wall 61 to form a hook. A guide 81 is bolted in place over the shank portion of the control link 79 to retain the control link in the side wall openings 77 and to limit the motion of the control link to up and down movements. As the operator squeezes a trigger 67 up into the respective handle cavity 65, the upward movement of the trigger pulls the control link 79 up a short distance.

Figure 8:
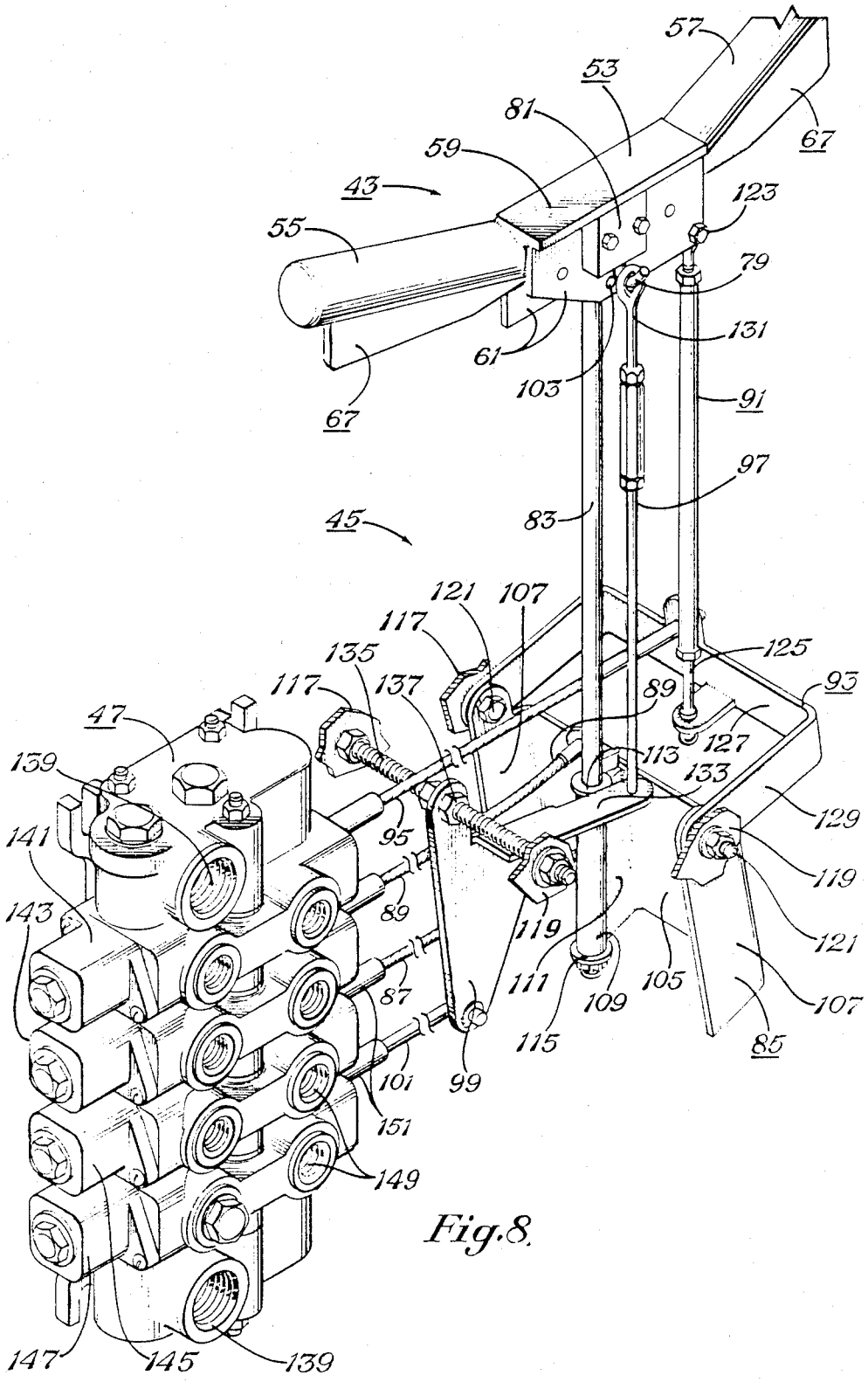
FIG. 8 is a schematic isometric view of the handle means, the linkage means, and the control valve assembly with the mounting means partially cut away.

The linkage means 45 will now be described with reference to FIG. 8. The linkage means 45 includes a lower boom/swing linkage rod 83, a lower boom actuator bracket 85, a lower boom control cable 87, a swing control cable 89, an upper boom linkage rod 91, an upper boom actuator bracket 93, an upper boom control cable 95, a boom enablement linkage rod 97, a boom enablement bell crank 99, and a boom enablement rod 101. The upper end portion of the lower boom/swing linkage rod 83 is received by the channel 63 of the handle means central portion 53 (see FIGS. 6 and 7) at a point midway between the central portion ends where it is fastened between the central portion side walls 61 with a clevis pin 103 so as to permit pivoting of the handles 55, 57 about a horizontal axis extending through the clevis pin. The lower end portion of the lower boom/swing linkage rod 83 is connected to the lower boom actuator bracket 85. The lower boom actuator bracket 85 is a shallow U-shaped bracket, having a central wall 105 and two side walls 107. The lower boom actuator bracket 85 has a hollow cylinder 109 which is parallel to the side walls 107 of the lower boom actuator bracket and which receives the lower end portion of the lower boom/swing linkage rod 83. The hollow cylinder 109 is secured to the central wall 105 of the lower boom actuator bracket 85 by a support flange 111. The lower boom/swing linkage rod 83 is prevented from moving in and out of the hollow cylinder 109 by flanged bearings 113, 115 positioned along the lower boom/swing linkage rod such that the respective flanged bearings are adjacent to the respective upper and lower ends of the hollow cylinder. The lower boom actuator bracket 85 is pivotally attached at the upper end portion of the side walls 107 to the mounting means 49, which include a back mounting plate 117 and a front mounting bracket 119 (see FIG. 5), by bolt and bearing means 121. The lower boom control cable 87 extends from the central wall 105 of the lower boom actuator bracket 85, where it is fixed in a conventional manner to the control valve assembly 47. The lower boom/swing linkage rod 83 has an L-shaped bracket for the attachment, in a conventional manner, of the swing control cable 89. The L-shaped bracket is welded to the lower boom/swing linkage rod 83 so that the L-shaped bracket turns in unison with the lower boom/swing linkage rod whenever the lower boom/swing linkage rod is pivoted about its longitudinal axis. The longitudinal axis of the swing control cable 89 perpendicularly intersects the lower boom actuator bracket 85 pivot axis as established by the bolts of the bolt and bearing means 121 when the handle means 43 is in a neutral position.

Figure 6:
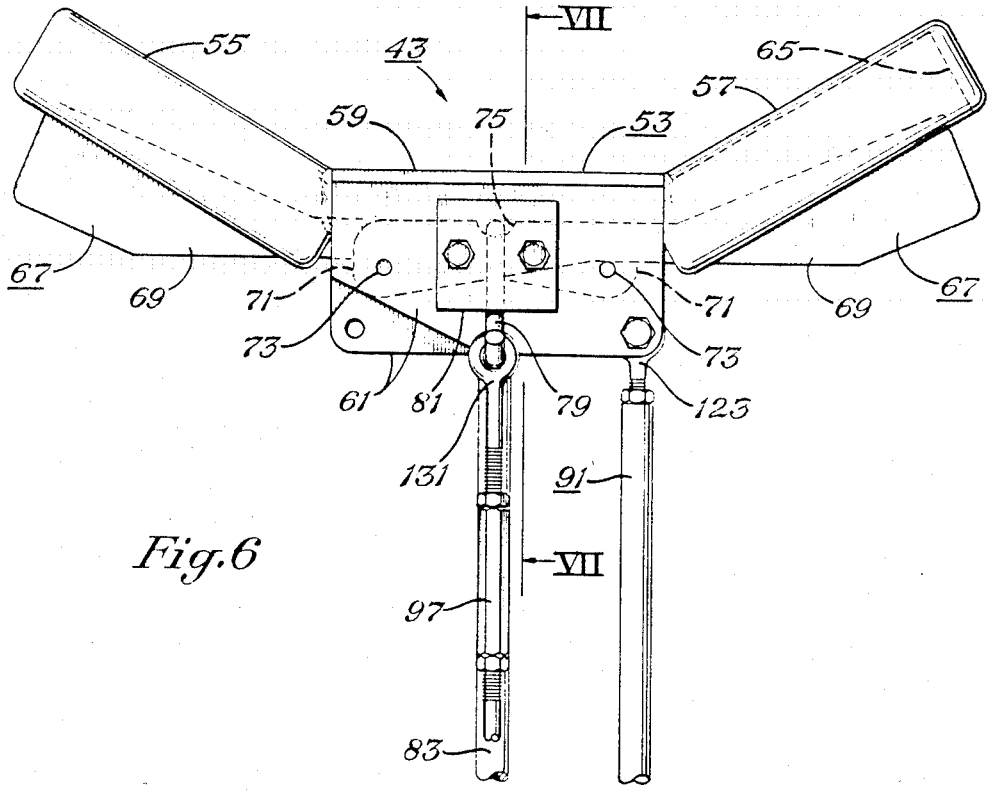
FIG. 6 is a schematic side elevational view of the handle means and a portion of the linkage means of FIG. 5.

The upper end portion of the upper boom linkage rod 91 is a ball joint 123 which is bolted to one of the bottommost corners of the handle means central portion 53 so as to be pivotally coupled thereto (see also FIG. 6). The lower end portion of the upper boom linkage rod 91 is a cable 125 and is connected to the upper boom actuator bracket 93. Like the lower boom actuator bracket 85, the upper boom actuator bracket 93 is also U-shaped, having a central wall 127 and two side walls 129. The cable 125, which forms the lower end portion of the upper boom linkage rod 91, is coupled to the central wall 127 of the upper boom actuator bracket in a conventional manner. The upper boom actuator bracket 93 is pivotally attached at the end portions of the side walls 129 to the back mounting plate 117 and the front mounting plate 119 by the bolt and bearing means 121. While the lower boom actuator bracket 85 extends in a generally downward direction from the bolt and bearing means 121, the upper boom actuator bracket 93 extends laterally in a direction away from the control valve assembly 47. The upper boom control cable 95 is connected to the central wall 127 of the upper boom actuator bracket in a conventional manner.

The upper end portion of the boom enablement linkage rod 97 is an eyebolt 131 which engages the hook lower end portion of the control link 79. The control link 79 of the handle means is positioned such that when a trigger 67 is squeezed and the control link is lifted up, the horizontal pivot axis of the upper end portion of the boom enablement linkage rod 97 is coaxial to the horizontal pivot axis of the upper end portion of the lower boom/swing linkage rod 83 and its clevis pin 103. The lower end portion of the boom enablement linkage rod 97 is connected to the boom enablement bell crank 99. The boom enablement bell crank 99 is generally a flat plate with one of its upper end portions bent at a right angle to the remainder of the plate to form a flange 133. A pivot rod 135 extends at right angles through the unbent upper portion of the bell crank 99. The end portions of the pivot rod 135 are attached to the back mounting plate 117 and to the front mounting plate 119. The movement of the boom enablement bell crank 99 along the pivot rod 135 is restrained by bolt and bearing means 137, which allows the bell crank to pivot about the pivot rod. The lower end of the boom enablement linkage rod 97 is connected to the bell crank flange 133 in a conventional manner and at a location that is in line with the pivot axis of the lower and upper boom actuator brackets 85, 93 when one of the triggers 67 is squeezed. The boom enablement rod 101 is connected to the lower end portion of the boom enablement bell crank 99.

The control valve assembly 47 is conventional and has hydraulic fluid supply and return ports 139 and four control sections, namely the upper boom control section 141, the swing control section 143, the lower boom control section 145, and the boom enablement control section 147. The boom enablement control section 147, hydraulically enables, internally in the control valve assembly 47, the other control sections. The upper boom, swing and lower boom control sections each have two hydraulic fluid output ports 149 for the respective power means, while the boom enablement control section has one hydraulic fluid output port for hydraulically enabling tool accessories. The various hose connections are not shown for clarity. Actuation members 151 extend $1\frac{7}{8}$ inches. In the preferred embodiment, cables are used instead of rods to connect the control valve assembly actuation members 151 to the actuator brackets and linkage rods because cables can flex in all directions. This makes it possible to simplify some of the linkage arrangements and also to reduce lost motion. Return springs (not shown) are provided in each control section to maintain the actuation members and thus the linkage means and handle means in a center or neutral position.

The operation of the control handle arrangement of the present invention will now be described, with reference to FIGS. 4 and 8. To enable the means for powering boom movements so as to permit boom movement, the operator grips one of the handles 55, 57 and squeezes the respective "dead man" trigger. This causes the boom enablement bell crank 99 to rotate counterclockwise and pull the boom enablement rod 101 The operator must continually squeeze one of the triggers during boom movements. To actuate the lower boom 13, the operator moves the handle means 43 in a fore or aft direction. The fore and aft motion of the handle means 43 causes the lower boom linkage rod 83 and the lower boom actuator bracket 85 to pivot about a first horizontal axis which extends through the bolt and bearing means 121. The lower boom actuator bracket 85 pushes or pulls the lower boom control cable 87. To swing both booms, the operator moves the respective handle clockwise or counterclockwise to pivot the handle means 43 about the vertical longitudinal axis of the lower boom/swing linkage rod 83 which causes the L-shaped bracket to correspondingly turn and push or pull the swing control cable 89. To actuate the upper boom 15, the operator pulls up or pushes down on one of the handles 55, 57 to pivot the handle means 43 about a second horizontal axis extending through the clevis pin 103 at the upper end portion of the lower boom/swing linkage rod, causing the upper boom linkage rod 91 to move upwardly or downwardly which motion in turn causes the upper boom actuator bracket 93 to pivot and thereby push or pull the upper boom control cable 95.

With the control handle arrangement of the present invention, control handle movements will always correspond with the desired direction of bucket movement for lower boom angular movements and for both lower and upper boom swinging movements for all operational zones, provided that the operator is facing in the correct direction. This correct direction is always the direction away from the vertical axis of boom swinging movement (which is the centerline of rotation of the lower boom about the pedestal structure 29). When the operator is facing in the correct direction, the direction of handle movement for the upper boom angular movement will always correspond to the direction of upper boom angular movement. Thus, for all operational zones, when the control handle is moved in the clockwise direction, the upper boom will move in the corresponding clockwise direction, and when the control handle is moved in the counterclockwise direction, the upper boom will move in the corresponding counterclockwise direction.

With the bucket 17 located in the non-overcenter zone of operation, as shown in FIG. 1, the operator faces in the correct direction, grips the first handle 55 with his left hand, and utilizes directional handle control movements that correspond to the desired direction of bucket movement. When the bucket 17 located in the overcenter zone of operation, as shown in FIG. 3, the operator must turn around from the non-overcenter orientation just described in order to face the correct direction. He then grips the second handle 57 with his right hand. As in the non-overcenter zone, the operator in the overcenter zone utilizes directional handle control movements that correspond to the desired direction of bucket movement. Thus, in the non-overcenter zone of operation, the operator pulls up on the first handle 55 with his left hand to unfold or raise the upper boom 15 (move the bucket upward). Conversely, the operator pushes down on the first handle 55 with his left hand to fold or lower the upper boom 15 (move the bucket downward). In the overcenter zone of operation, the operator pulls up on the second handle 57 with his right hand to fold or raise the upper boom (move the bucket upward) and pushes down on the second handle to unfold or lower the upper boom (move the bucket downward). For upper boom control the handle means 43 pivots about a horizontal axis extending through the clevis pin 103 and between the first and second handles 55, 57. As described for the non-overcenter zone of operation, pulling up on the first handle 55 unfolds the upper boom 15. This upward movement of the first handle results in a downward movement of the second handle 57, because of the pivoting movement of the handle means 43 about the horizontal axis. Such a downward movement by the second handle 57 is the required movement which unfolds or lowers the upper boom in the overcenter zone of operation.

To swing the booms the operator pushes or pulls a handle to the right or left. In the non-overcenter zone of operation, the operator pulls the first handle 55 with his left hand clockwise or to the right to swing the booms clockwise or to move the bucket to the operator's right. The operator pushes the first handle 55 counterclockwise or to the left to swing the booms counterclockwise or to move the bucket to the operator's left. In the overcenter zone of operation, the operator pushes the second handle 57 with his right hand clockwise or to the right to swing the booms clockwise or move the bucket to the operator's right. The operator pulls the second handle 57 counterclockwise or to the left to swing the booms counterclockwise or to move the bucket to the operator's left. For control of boom swing, the handle means 43 pivots about a vertical axis that extends between the first and second handles 55, 57. With the operator positioned for the non-overcenter zone of operation, pulling the first handle 55 to the operator's right swings the booms clockwise. The movement of the first handle 55 to the right results in the second handle 57 moving to the left due to pivoting movement of the handle means 43 about the vertical axis. Such movement to the left by the second handle 57 when the operator is positioned for the non-overcenter zone of operation is the required movement which swings the booms clockwise in the overcenter zone of operation.

To affect lower boom movement in the non-overcenter zone of operation, the operator pushes the first handle 55 forward to raise the lower boom 13 (move the bucket forward). Conversely, the operator pulls the first handle aft to lower the lower boom 13 (move the bucket aft). In the overcenter zone of operation, the operator pushes the second handle 57 forward to lower boom 13 (move the bucket forward) and pulls the second handle aft to raise the lower boom (move the bucket aft).

Thus, for all bucket locations and operational zones, when the operator is facing the correct direction, and is grasping the correct handle 55, 57 (the one that is forward of the perpendicular bisector of the handle means 43) the bucket will achieve a translational movement in the same direction that the handle is moved.

The essence of the present invention is that it makes the boom movement controls "user friendly" in that no matter which zone of operation the bucket is in the direction the bucket moves corresponds to the direction of handle movement. This is accomplished by utilizing a handle means with two handles and logical handle control movements. The handle control movements for the upper boom and swing controls in particular take advantage of the double handle arrangement due to the positioning of a handle on either side of the upper boom and swing pivot axes. In addition, the boom movement controls are "user friendly" in the sense that when the operator is correctly positioned in the bucket, the control handle that he will use is within convenient reach and can be manipulated with ease and comfort.

The foregoing disclosure and the showings made in the drawings are merely illustrative of the principles of the invention and are not to be interpreted in a limiting sense.

We claim:

1. An aerial lift, comprising:

a. a lower boom having upper and lower ends, with said lower boom lower end being coupled to a pedestal, said lower boom being pivotable about its lower end in a generally vertical plane, b. an upper boom having inner and outer ends with a longitudinal axis extending between said ends, said upper boom inner end pivotably coupled to the upper end of said lower boom, said upper boom being pivotable from a folded position such that the upper boom outer end pivots about its connection with the lower boom in a generally vertical plane that is parallel to the vertical plane in which said lower boom pivots, c. a personnel carrier bucket mounted to the outer end of said upper boom so as to be movable with said upper boom, d. said lower boom and said upper boom swingable together about a vertical axis extending through said pedestal, e. means for powering said lower boom pivotal movement, said upper boom pivotal movement and said lower boom and upper boom swing movement, f. handle means located on one side of said bucket, said handle means being movable so as to control said boom movements via linkage means, g. said upper boom having an overcenter capability wherein said upper boom can pivot from the upper boom folded position past a center position, which is defined as that position where the longitudinal axis of the upper boom is vertical, said upper boom being in a non-overcenter zone of operation when said upper boom is located between its folded position and its center position and said upper boom being in an overcenter zone of operation when said upper boom has pivoted past its center position from the non-overcenter zone of operation, h. said handle means having a first handle and a second handle such that an operator can utilize said first handle to control said boom movements for some zones of operation and can utilize said second handle to control said boom movements for other zones of operation, i. said handles having control movements such that the direction the bucket moves corresponds to the direction the respective handle moves in all zones of operation.

2. The aerial lift of claim 1 wherein said handle means has a central portion to which said first and second handles are rigidly mounted, said central portion having two ends which are opposite to one another with said first handle extending out from one central portion end and with said second handle extending out from the other central portion end, said handles each having a central axis, said handle central axes lying in a common plane.

3. The aerial lift of claim 2 wherein said handles extend outwardly from said central portion with an upward inclination.

4. The aerial lift of claim 1 wherein said handle means is pivotable about a vertical axis extending between said first and second handles so as to control said lower boom and upper boom swing movements, pivotable about a first horizontal axis so as to control said lower boom pivotal movement and pivotable about a second horizontal axis so as to control said upper boom pivotal movement, said first and second horizontal axes being perpendicular to said upper boom longitudinal axis and to said vertical axis extending between said handles.

5. The aerial lift of claim 3 wherein said handle means is pivotable about a vertical axis extending between said first and second handles and through said central portion so as to control said lower boom and upper boom swing movements, pivotable about a first horizontal axis so as to control said lower boom pivotal movement and pivotable about a second horizontal axis so as to control said upper boom pivotal movement, said first and second horizontal axes being perpendicular to said upper boom longitudinal axis and to said vertical axis extending between said handles.

6. The aerial lift of claim 1 wherein said first and second handles each have means for enabling said means for powering the boom movements from said bucket.

7. The aerial lift of claim 2 wherein said first and second handles each have means for enabling said bucket.

8. The aerial lift of claim 1 wherein said first and second handles are rigidly interconnected and extend outwardly in opposite directions from said rigid interconnection, with said handles each having a central axis, and with said axes lying in a common plane.

* * * * *